United States Patent [19]

Yoshikawa et al.

[11] Patent Number: 4,697,498

[45] Date of Patent: Oct. 6, 1987

[54] DIRECTION CONTROL VALVE FITTED WITH A FLOW CONTROL MECHANISM

[75] Inventors: Seiji Yoshikawa; Isao Sato; Shigenori Nakayama; Mitsuhiro Amazaki, all of Kariya, Japan

[73] Assignee: Kabushiki Kaisha Toyoda Jidoshokki Seisakusho, Kariya, Japan

[21] Appl. No.: 900,402

[22] Filed: Aug. 26, 1986

[30] Foreign Application Priority Data

Sep. 10, 1985 [JP] Japan ..... 60-201097

[51] Int. Cl.[4] ..... F15B 13/04

[52] U.S. Cl. ..... 91/420; 91/447

[58] Field of Search ..... 91/420, 447

[56] References Cited

U.S. PATENT DOCUMENTS 2,618,121 11/1952 Tucker ..... 91/420
4,172,582 10/1979 Bobnar ..... 91/420 X
4,244,275 1/1981 Smilges ..... 91/420
4,287,812 9/1981 Iizumi ..... 91/420
4,461,449 7/1984 Turner ..... 91/420 X

*Primary Examiner*—Gerald A. Michalsky

[57] ABSTRACT

There is disclosed a spool type direction control valve for controlling the oil flow direction in a hydraulic circuit including a pressure source, a hydraulic cylinder and a spool member. A flow control mechanism is provided in an oil passage connecting one of the oil chambers of the hydraulic cylinder to the spool member. The flow control mechanism comprises a poppet type piston adapted for opening and closing the oil passage. When the spool member is switched over for supplying the pressure fluid to the other oil chamber of the hydraulic cylinder, the pilot pressure from the pressure source is caused to act on the piston in the valve opening direction, while the back pressure of the discharge side pressure fluid corresponding to the load acting on the one oil chamber is caused to act on the piston in the valve closing direction, so as to control the discharge flow of the pressure fluid from the one oil chamber.

3 Claims, 3 Drawing Figures

DIRECTION CONTROL VALVE FITTED WITH A FLOW CONTROL MECHANISM

BACKGROUND OF THE INVENTION

This invention relates to a spool type direction control valve for controlling the flow direction of an hydraulic circuit and, more particularly, to a direction control valve fitted with a flow control mechanism.

A variety of direction control valves of this type have been used thus far in the art. Typical of these is the construction disclosed in Japanese Patent Publication No. 49-21693.

FIG. 1 shows a direction control valve of the spool translation type which is used for controlling the flow of the pressure oil into and from a tilting cylinder for a forklift truck.

In the operation of the direction control valve, when a spool member 31 is displaced towards the left in FIG. 1, a plunger 33 is shifted towards the left by the pressure prevailing in an oil supply port 32 and against the force of a spring 34 so as to establish hydraulic communication between grooves 35 and 36 so that the pressure fluid from the supply port 32 is conveyed from the supply port 32 through these grooves 35 and 36 and a connecting pipe 37 to the head side oil chamber 38*a* in the tilting cylinder 38. On the other hand, since the displacement of the plunger 33 puts the grooves 39 and 40 into communication with each other, the pressure fluid in the rod side oil chamber 38*b* to a tank port 42 through a connecting pipe 41 and the grooves 39, 40, so that the mast is tilted forwards. Conversely, when the spool member 31 is displaced towards the right, the pressure oil from the supply port 32 causes a check valve 43 to open so that it may flow from the groove 40 into the groove 39 such that the pressure oil is supplied through the connecting pipe 41 into the rod side oil chamber in the tilting cylinder 38. At this time, a small plunger 44 is shifted towards the right in FIG. 1 by the fluid pressure prevailing in the supply side, against the force of a spring 45, so as to establish hydraulic communication between the grooves 35 and 36 through a groove 46 formed in the small plunger 44 so that the pressure fluid in the head side oil chamber in the tilting cylinder 38 flows into the tank port 47 through the connecting pipe 37 and grooves 36, 35 for tilting the mast rearwards.

The above described direction control valve shown in FIG. 1 has a defect in that it is highly complicated in structure. In addition, since the sectional area of the pressure oil passage during mast tilting is dictated by the plunger position controlled in turn by the spring and the pilot pressure of the supply side pressure fluid, the speed of forward tilting during such forward mast tilting is changed as a function of the load acting in the forward tilting direction, even granting that the pressure fluid in the rod side oil chamber of the tilting cylinder is discharged via throttling means. Also, since the passage is opened and closed by plunger operation, the pressure fluid cannot but leak under the shut-off state with the spool in the neutral position. Thus there is an additional defect in that the mast, which is subject at all times to the load acting in the forward tilt direction, can not be maintained for a prolonged time at a fixed position.

SUMMARY OF THE INVENTION

It is therefore a principal object of the present invention to overcome the aforementioned problems inherent in prior direction control valves fitted with a flow control mechanism.

For accomplishing the object, the present invention provides a direction control valve in which the flow direction towards a hydraulic cylinder of the pressure fluid introduced from a pressure source into a valve body is controlled by the switching operation of a spool member, wherein, according to the invention, there is provided, in a passage connecting one of the oil chambers of the hydraulic cylinder to the spool member, a flow control mechanism consisting essentially of a poppet type piston adapted for opening and closing the passage. When the spool member is switched over for supplying the pressure fluid to the other oil chamber of the hydraulic cylinder, the pilot pressure from the pressure source is caused to act on said poppet type piston in the valve opening direction, while the back pressure of the discharge side pressure fluid corresponding to the load acting on the one oil chamber of the hydraulic cylinder is caused to act on the piston in the valve closing direction, in a manner to control the flow of the pressure fluid from the one oil chamber of the hydraulic cylinder.

DESCRIPTION OF THE PREFERRED EMBODIMENTS

Figure 1:
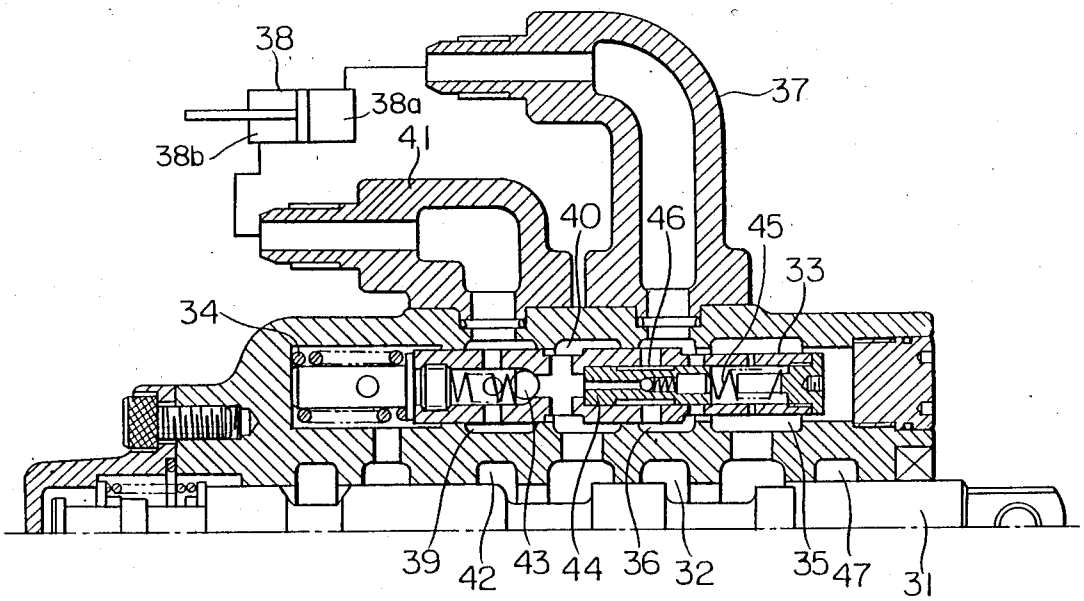
FIG. 1 (PRIOR ART)
FIG. 1 is a sectional view showing a prior-art direction control valve.
Figure 2:
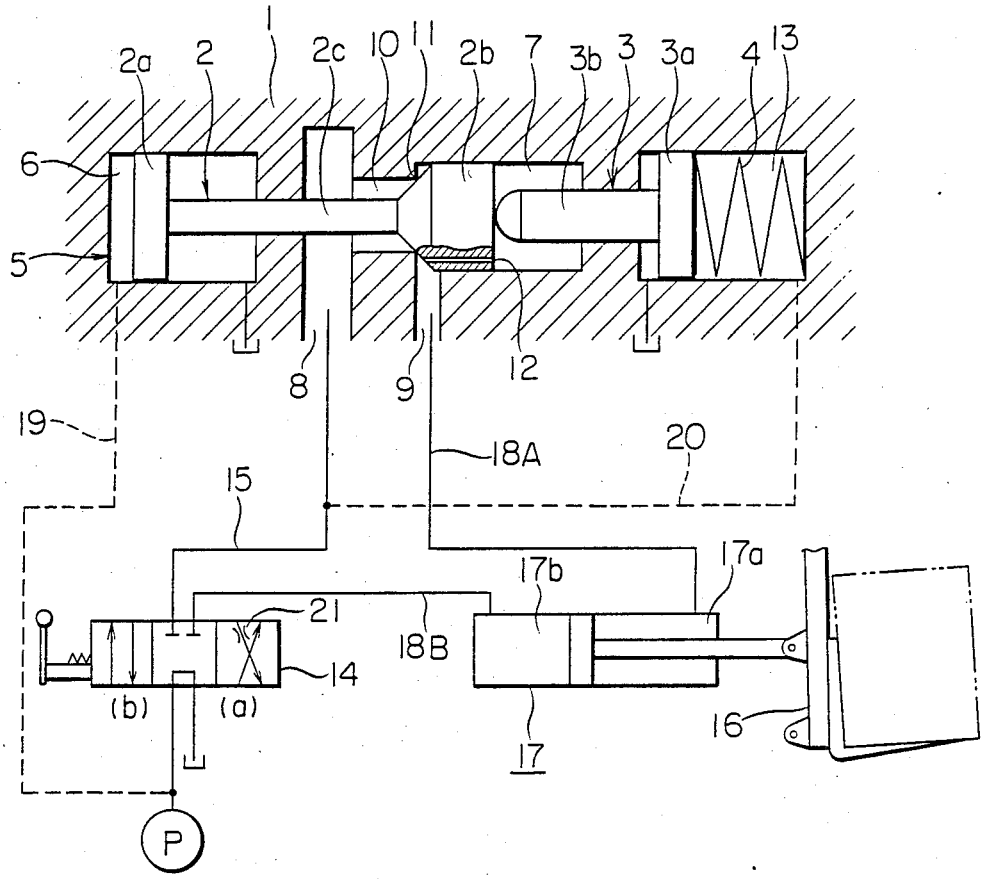
FIG. 2 is a sectional view showing the direction control valve according to a first embodiment of the present invention.

Reference is made to FIG. 2 illustrating a direction control valve fitted with a flow control mechanism according to a first embodiment of the present invention. In the drawing, the numeral 1 designates a valve body in which there are incorporated a flow control unit 5 made up of a first piston 2, a second piston 3 and a spring 4, and a translation or direct acting type spool member 14. The first piston 2 at the left side in FIG. 2 has an integral structure comprised of a left-hand side piston portion 2*a* slidable within a first pressure chamber 6, a right-hand side poppet portion 2*b* slidable within a second pressure chamber 7, and a rod 2*c* coaxially connecting the piston and poppet portions 2*a* and 2*b* to each other. The poppet portion 2*b* is adapted to seat on or be separated from a seat 11 formed on a circular passage 10 adapted for providing hydraulic communication between a first port 8 and a second port 9. It will be noted that an orifice 12 is formed in the poppet portion 2*b* for providing hydraulic communication between the second port 9 and the second pressure chamber 7. The first port 8 communicates with an operating port in a spool member 14 through an oil passage 15 formed in the valve body 1, while the second port 9 communicates via oil passage 18A with a rod side oil chamber 17*a* in the tilting cylinder 17 adapted for tilting the mast 16 in the forklift truck. A head side oil chamber 17*b* in the tilting cylinder 17 communicates via an oil passage 18B with another operating port in the spool member 14.

The second piston 3 at the right-hand side in FIG. 2 is made up of a piston portion 3*a* slidable within a third pressure chamber 13 and a rod portion 3b abutting on an end face of the poppet portion 2b of the first piston 2 and is urged towards the first piston 2 by the spring 4 disposed within the third pressure chamber 13.

The pressure chambers 6, 7 and 13 in the above described flow control unit 5 are subject to pilot pressures derived from different oil systems. Thus a pilot pressure from a hydraulic pump P is introduced into the first oil chamber 6 by way of a pilot line 19 for thrusting the piston portion 2a of the first piston 2 towards the right, while a pilot pressure derived from the rod side oil chamber of the tilting cylinder 17 is introduced via pilot line 18A and orifice 12 into the second pressure chamber 7 for thrusting the poppet portion 2b of the first piston 2 towards the left. On the other hand, the pilot pressure derived from the hydraulic pump P and conveyed through the spool member 14 or the back pressure of the pressure fluid discharged from the rod side oil chamber 17a when the tilting cylinder 17 is tilted forwards is introduced into the third pressure chamber 13 via pilot line 20 for thrusting the piston portion 3a of the second piston 3 towards the left. The spool member 14 is provided with a throttle 21 for limiting the flow of the pressure fluid discharged from the rod side oil chamber 17a when the tilting cylinder 17 is tilted forwards. In the neutral position, the pump and tank ports are communicated with each other.

The above described direction control valve of the first embodiment operates as follows:

(When Hydraulic Pump P is Halted)

Since a low pilot pressure prevails in both the first pressure chamber 6 and the third pressure chamber 13, the first piston 2 is subject to a leftwards acting force in FIG. 2 by the spring 4 acting on the second piston 3 and the pilot pressure from the rod side oil chamber 17a of the tilting cylinder 17 acting on the second pressure chamber 7, it being understood that the load acts at all times on the rod-side oil chamber due to the weight of the associated material handling device, whereby said circular passage 10 is closed by said poppet portion 2b being contacted with said seat 11. In this case, however, the pilot pressure acts to the right on the taper surface of the poppet portion 2b of the first piston 2 so that a pressure corresponding to the differential area between the right-hand end pressure-receiving surface and the tapered pressure-receiving surface of the poppet portion 2b acts to urge the poppet portion 2b leftwards. Therefore, the poppet portion 2b is made to seat with the seat 11 with the combined force of the pressure of the spring 4 and the pilot pressure equivalent to the differential pressure receiving area.

(Forward Mast Tilting)

When the spool member 14 is switched over to forward tilting (a), the pressure fluid from the hydraulic pump P is supplied via oil passage 18B into head-side oil chamber 17b of the tilting cylinder 17. At this time, the pilot pressure from the hydraulic pump P is larger than the combined force of the pressure of the spring 4 and the pilot pressure in the second pressure chamber 7 and acts on the first pressure chamber 6 to cause the first piston 2 to be shifted towards the right. As a result, the poppet portion 2b of the first piston 2 is displaced from the seat 11 to open the oil passage 10. Thus a limited amount of the pressure fluid contained in the rod side oil chamber 17a of the tilting cylinder 17 is discharged into the tank by way of the oil passage 18A, second port 9, oil passage 10, first port 8, oil passage 15 and the throttle 21 of the spool member 14.

In this manner, the tilting cylinder 17 is actuated in a direction for extending the piston rod thereof for tilting the mast 16 forward. In this case, when the first piston 2 is moved rightwards, the force of the spring 4 increases, while the back pressure of the pressure fluid discharged from the rod side oil chamber 17a of the tilting cylinder 17 acts on the third pressure chamber 13 via the line 20, so that the force thrusting the first piston 2 towards the left increases. As a result thereof, the first piston 2 is stabilized at a position where the combined force of the spring pressure and the back pressure is counterbalanced by the pilot pressure prevailing in the first pressure chamber 6. Thus the poppet portion 2b that determines the opening degree of the oil passage 10 assumes a position corresponding to the value of the back pressure exerted by the pressure fluid at the discharge side of the tilting cylinder 17, i.e. the magnitude of the load acting on the material handling device. Thus the greater the magnitude of the load, the lesser the opening degree of the oil passage 10 and the discharge flow from the tilting cylinder 17 become.

(Rearward Mast Tilting)

When the spool member 14 is switched to rearward tilting (b), the pilot pressure from the hydraulic pump P acts on the first pressure chamber 6 through a pilot line 19, while also acting on the third pressure chamber 13 through a pilot line 20. On the other hand, the pressure fluid from the pump P acts directly on the tapered surface of the poppet portion 2b via the first port 8 and oil passage 10. Thus, as the force for displacing the first piston 2 towards the right, pump pressure acts on the tapered surface of the poppet portion 2b and the first pressure chamber 6. This force is counteracted by the force combined from the pressure of the spring 4, the pilot pressure at the rod side of the tilting cylinder 17 acting on the second pressure chamber 7 and the pilot pressure of the hydraulic pump P acting on the third pressure chamber 13.

In this manner, the poppet portion 2b may be separated from the seat 11 for opening the oil passage 10 by setting the pressure receiving area of the first piston 2 and that of the second piston 3 such that the force for thrusting the first piston 2 towards the right will be in excess of that towards the left. In this manner, the pressure fluid from the pump P is supplied via second port 9 and oil passage 18A to the rod side oil chamber 17a of the tilting cylinder 17 for retracting the piston rod for tilting the mast rearwards.

(Neutral Position)

When the spool member 14 is switched to its neutral position as shown, the hydraulic pump P is communicated with the tank and the pressure in the first pressure chamber 6 is lowered. Thus the first piston 2 is shifted towards the left under the force of the spring 4 and the pressure from the rod-side oil chamber 17a of the tilting cylinder 17 acting on the second pressure chamber 7, so that the poppet portion 2b is brought to seat with the seat 11 to thereby seal the passage 10.

Figure 3:
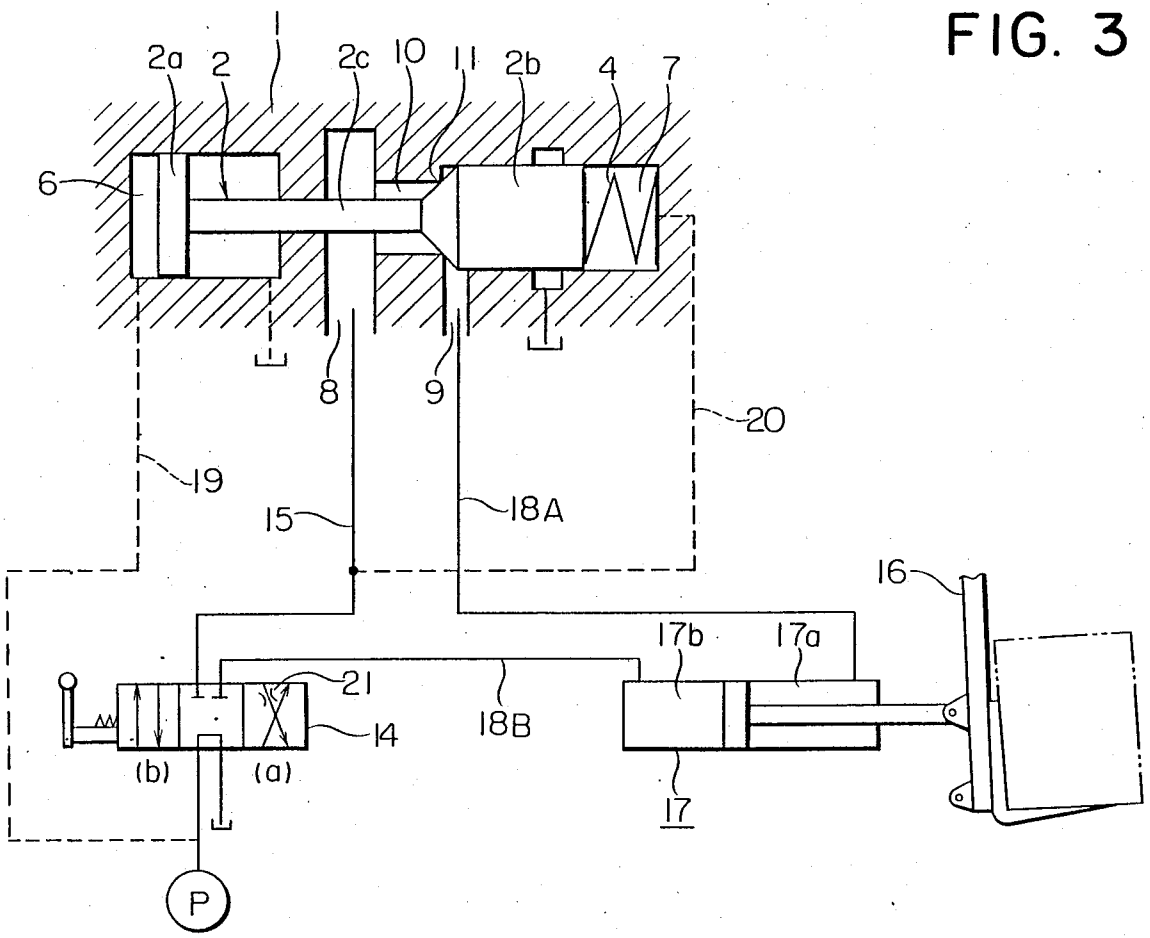
FIG. 3 is a sectional view showing the direction control valve according to a second embodiment of the present invention.

The second embodiment of the present invention will be explained by referring to FIG. 3. In the present second embodiment, the so-called double piston type flow control unit according to the preceding embodiment of FIG. 2 is replaced by a single piston type unit. In the present embodiment, the pilot pressure of the hydraulic pump P is introduced into the first pressure chamber 6 in which the piston portion 2*a* of the piston 2 is engaged, while the back pressure of the discharged fluid from the rod side oil chamber 17*a* of the tilting cylinder 17 is introduced into the second pressure chamber 7 in which the poppet portion 2*b* is engaged. However, the force of the spring 4 is selected to be stronger than that for the first embodiment and is also selected to be sufficient enough to overcome the pressure from the rod side oil chamber 17*a* of the tilting cylinder 17 acting on the tapered surface of the poppet portion 2*b*.

Thus, in the neutral state of the spool member 14 or when the hydraulic pump P is at a standstill, the poppet portion 2*b* is seated with the seat 11 to seal the oil passage 10 for holding the tilting cylinder at a standstill state.

When the spool member 14 is switched to forward tilting (a), the pressure fluid from the hydraulic pump P is supplied to the head side oil chamber 17*b* of the tilting cylinder 17, while the pilot pressure of the hydraulic pump P acting on the first pressure chamber 6 acts to shift the piston 2 rightwards, the poppet portion 2*b* then opening the oil passage 10 and the pressure fluid in the rod-side oil chamber 17*a* of the tilting cylinder 17 being returned to the tank via the line 18A, port 9, passage 10, port 8, line 15 and throttle 21. In this case, the back pressure of the pressure fluid at the discharge side of the tilting cylinder 17 is also introduced into the second pressure chamber 7 via line 20 for acting as a force thrusting the piston 2 leftwards as in the first embodiment described above. As a result, the degree of opening of the passage by the poppet portion 2*b* is linearly correlated with the magnitude of the back pressure corresponding to the load acting on the tilting cylinder 17. Thus the tilting cylinder 17 acts to tilt the mast 16 forwards at a controlled speed which is linearly correlated with load magnitude.

When the spool member 14 is switched to rearward tilting (b), the pilot pressure from the hydraulic pump P acts separately on the first pressure chamber 6 and the second pressure chamber 7, while the pressure fluid from the pump P acts on the tapered surface of the poppet portion 2*b*, so that the piston 2 is shifted towards the right for opening the oil passage 10. Thus the pressure fluid from the hydraulic pump P is supplied to the rod-side oil chamber 17*a* of the tilting cylinder 17, while that in the head side oil chamber 17*b* is returned into the tank T via line 18B, the tilting cylinder 17 tilting the mast 16 rearwards.

From the foregoing it will be seen that the present invention provides a direction control valve fitted with a flow control mechanism which is highly simplified in structure and in which pressure fluid leakage is almost nil when the pressure fluid is shut-off, so that the tilting cylinder can be accurately maintained at the position at which it halted, whereas, with the mast tilted forwards, the speed of forward tilting can be controlled in relation to the magnitude of the load acting on said mast in the direction of forward tilting.

What is claimed is:

1. A direction control valve for controlling the flow of fluid under pressure between a fluid pressure source and an hydraulic cylinder having a reciprocally movable, fluid-actuated piston therein carrying rod means connected to an exterior device whereby movement of said piston drives said device, said hydraulic cylinder having first and second fluid chambers separated by said movable piston, said direction control valve comprising spool valve means connected to said pressure source and having a movable spool member operable to alternately reverse the direction of fluid flow within said direction control valve and to an from said hydraulic cylinder, a flow control mechanism comprising first pressure chamber means having a poppet seat, and a second pressure chamber, a poppet-type piston mounted within said first pressure chamber means for reciprocal movement into and away from closing engagement with said poppet seat, spring means urging said poppet-type piston towards its said closing position, a second piston mounted for reciprocal movement within said second pressure chamber, and rod means connecting said poppet-type piston and said second piston for concurrent movement, a first fluid passage extending between said first fluid chamber of said hydraulic cylinder and said spool valve means for connection to said pressure source, a second fluid passage extending from said spool valve means into fluid communication with said poppet seat on one side thereof, a third fluid passage extending from said second fluid chamber of said hydraulic cylinder into fluid communication with said poppet seat on the other side thereof whereby, when said poppet-type piston is moved away from its said engagement with said poppet seat, said second and third fluid passages are in fluid communication with each other, a first pilot pressure passage extending from said pressure source to said second pressure chamber to apply fluid pressure urging said second piston in direction whereby said connecting rod means urges said poppet-type piston away from its said seat-engaging position, and a second pilot pressure passage extending from said second fluid passage to said first pressure chamber means to apply fluid pressure urging said poppet-type piston towards its said seat-engaging position, said spool valve means further comprising fluid throttle means for receiving and limiting fluid flow discharging from said second fluid chamber of said hydraulic cylinder when said first fluid chamber thereof is in fluid communication with said pressure source and said poppet-type piston is in its position away from said seat.

2. A direction control valve according to claim 1, wherein said first pressure chamber means comprises first and second piston chambers, said first piston chamber having said poppet seat and said poppet-type piston mounted for movement therein, said poppet-type piston having a conical forward end for engaging said seat and a rearward end, and a pilot passage therethrough to provide fluid communication between said forward and rearward ends thereof, a third piston mounted for reciprocal movement within said second piston chamber and carrying rod means extending into said first piston chamber for engaging said poppet-type piston, said spring means being mounted within said second piston chamber and urging said third piston whereby its said rod means engages said poppet-type piston, said second pilot pressure passage extending from said second fluid passage to said second piston chamber.

3. A direction control valve according to claim 1, wherein said exterior device is a load-tilting mast of a forklift truck.

* * * * *